United States Patent [19]

Montgrain

[11] 4,290,590

[45] Sep. 22, 1981

[54] APPARATUS FOR SPARGING MOLTEN METAL BY GAS INJECTION

[75] Inventor: Luc Montgrain, Chicoutimi, Canada

[73] Assignee: Alcan Research and Development Limited, Montreal, Canada

[21] Appl. No.: 17,165

[22] Filed: Mar. 2, 1979

[30] Foreign Application Priority Data

Mar. 6, 1978 [GB] United Kingdom ..... 8825/78

[51] Int. Cl.[3] ..... C22B 21/06

[52] U.S. Cl. ..... 266/225; 261/122; 164/266

[58] Field of Search ..... 266/217-224, 266/225, 226; 261/113, 122, 123; 210/69; 75/51, 52, 68 R, 93 R, 93 E, 59, 60; 164/266

[56] References Cited

U.S. PATENT DOCUMENTS

| | | | |
|---|---|---|---|
| 23,123 | 3/1859 | Stewart et al. | 266/217 |
| 536,904 | 4/1895 | Williams | 266/224 |
| 2,562,813 | 7/1951 | Ogorzaly | 266/221 |
| 3,010,712 | 11/1961 | Judge et al. | 266/225 |

FOREIGN PATENT DOCUMENTS

| | | | |
|---|---|---|---|
| 384378 | 8/1924 | Fed. Rep. of Germany | 75/60 |
| 2603965 | 6/1977 | Fed. Rep. of Germany | 266/225 |

*Primary Examiner*—M. J. Andrews

*Attorney, Agent, or Firm*—Cooper, Dunham, Clark, Griffin & Moran

[57] ABSTRACT

A process for sparging molten metal comprises passing gas bubbles upwardly through a series of spaced nozzles arranged in a trough or furnace, the nozzles being arranged to prevent lateral spread of emergent bubbles so as to hold down the bubble size to a controlled size and thus increase the surface area/volume relationship to a desired value.

The apparatus employed preferably is embodied in a refractory plate having a series of spaced protrusions or ribs on the upper face. Spaced gas orifices are formed in the protrusions or ribs. The lateral spread of the bubbles is checked or hindered when the gas/metal interface of growing bubbles reaches the sides of the protrusions or ribs.

14 Claims, 10 Drawing Figures

APPARATUS FOR SPARGING MOLTEN METAL BY GAS INJECTION

BACKGROUND OF THE INVENTION

The present invention is concerned with an apparatus and method for sparging or scavenging molten metal by injection of gas. The invention is primarily directed to the treatment of aluminium and its alloys, but is also useful for the treatment of other non-ferrous metals (and their alloys) such as copper, tin, zinc, lead, magnesium and brass.

It has long been known to reduce the gas content of molten metal and/or to remove dissolved volatile metallic impurities and/or to remove solid or liquid inclusions by passing a stream of gas bubbles through molten metal in a transfer ladle or a holding furnace before supply to a casting station or in transit from the holding furnace to the casting station. In general it is preferred to carry out a sparging or scavenging treatment as close as possible to the casting station so as far as possible to avoid recontamination of the molten metal before casting. However in many circumstances the sparging of the molten metal in the furnace is more convenient.

While the apparatus of the present invention has been designed to meet a problem which is common to both in-furnace sparging and in-transit sparging, it is intended in particular to simplify the performance of sparging in transit by transfer trough from the holding furnace to the casting station.

It is already known to treat molten metal while in transit from the holding furnace to the casting station by a variety of techniques, some of which involve gas injection, possibly in conjunction with filtration, while some involve filtration alone. The known treatment methods under consideration all require the passage of the molten metal through a special treatment station, which frequently requires separate heating to maintain a separate body of metal in a molten condition in a holding bath. The amount of metal so maintained may be as much as 1500 kg. or even 4000 kg. or more depending on the type of apparatus used. The use of apparatus of this kind is open to the objection that it occupies valuable floor space between the holding furnace and the casting station. Moreover, the volume of metal retained in the box must be either drained or flushed each time whenever a different alloy is to be cast, with consequent delay and loss in production. There is also the possibility of some deterioration of the metal during the time which elapses between casting operations. For example, a molten Al-Mg alloy may lose excessive amounts of Mg by oxidation in the holding bath during this period.

It is a principal object of the invention to increase efficiency of sparging by generating a fine dispersion of bubbles of sparging gas in the molten metal.

It is a further object of the invention to provide an improved apparatus for injection of gases into molten metal of such construction that the molten metal may be treated in the course of transit through a normal trough lying between the holding furnace and the casting station.

The efficiency of a mass of gas in scavenging gaseous and other impurities from molten metal is a function of the total surface area of the gas bubbles in contact with the melt at a given time as well as of the distribution and spacing of the bubbles through the melt. In general it may be said that the gas bubbles should be as small as is practicable provided they are not so small that the metal solidifies before they have risen to the surface. If this happens, the gas bubbles become entrapped in the cast ingot, causing micro-porosity. In most gas-sparging operations the gas is injected either through a open-ended lance or through a gas-permeable porous plate, which itself may form part of a lance. As compared with other liquids the interfacial tension at a gas/molten metal interface is very high with the result that at any surface through which gas is being emitted there is a tendency for the incipient gas bubble to spread out sideways on the non-wetted surface. At a porous plug, for example, this phenomenon can lead to agglomeration of incipient bubbles into a single large bubble, which floats up through the molten metal and is relatively ineffective, in terms of gas usage, because of its low surface area/volume ratio. Somewhat similar results occur when a conventional open-ended lance is substituted by a close-ended lance having a plurality of apertures in its side walls. It is also known to use rotating impellers to break up gas bubbles after they have separated from a lance or porous plate. However the latter solution may be inconvenient because it requires the use of a separate treatment station with the attendant inconveniences, already explained above, and because it may cause microporosity problems due to the carry-over in the molten metal of some exceedingly fine gas bubbles which are inevitably generated by the process.

SUMMARY OF THE INVENTION

It has now been realized, in accordance with the invention, that the size of the gas bubbles in a sparging operation may be reduced (without being excessively reduced in size and while still maintaining an adequate rate of gas flow) by emitting gas from a plurality of spaced gas orifices, which are surrounded by a surface of limited dimensions to control the size of the emitted gas bubbles. By use of protruding gas nozzles of small diameter (or other minimum transverse dimension) the lateral spread of the incipient gas bubbles is limited and in consequence the gas bubbles overcome the resistance of metal surface tension while the volume of the individual bubbles is at a small and relatively controlled size. Provided there is adequate spacing between the protruding nozzles to avoid contact between incipient bubbles emerging from adjacent nozzles, and provided the extent of the protrusion of the nozzles is sufficient, the size of the bubbles is controlled by the minimum transverse dimension of the outer end of the protrusion. Furthermore, because the bubble size is related to the cross-section of the top of the protrusion, formation of undesirably fine bubbles is prevented. Therefore, by proper dimensioning of the tops of the nozzle protrusions, the size of the bubbles can be controlled and "tailored" to any desired application. Although the nozzles may be separately formed for assembly with other members, they are preferably formed integrally into a diffuser plate formed from graphite or other refractory material which is resistant to molten metal.

In one method of sparging molten metal in accordance with the invention, molten metal in transit from a holding station to a casting station flowed over an array of gas-emitting nozzles, preferably formed in a diffuser plate having a plurality of spaced upward nozzle protrusions formed thereon, each of said protrusions having gas orifice means formed therein to supply gas from an associated gas plenum chamber under the diffuser plate. The diffuser plate was conveniently machined from a moulded graphite block in order to form protruding nozzles by cutting spaced longitudinal and transverse slots in one surface. Gas orifices were then drilled centrally in each protrusion thus formed. For resistance to mechanical shock and ease of metal skull removal after use, the protrusions were slightly tapered and in this example were square in cross section. For reasons of mechanical strength the graphite (or other refractory material) protrusions require a minimum transverse dimension which depend on the material used. Whilst a minimum transverse dimension (width) of 5 mm is therefore normally required at the outer end of the protrusion, some refractory materials may permit this dimension to be reduced to 3 mm with consequent reduction in bubble size. The gas-emission orifice in the nozzle protrusion should be as small as possible consistent with ease of fabrication and gas flow requirements. Using graphite protrusions of 5 mm width, a gas orifice of a diameter of 0.5 to 1 mm was found to secure an adequate rate of gas emission provided the gas supply pressure was sufficient to overcome the forces due to orifice restriction, metallostatic head and surface tension which resist the gas outflow.

The efficiency of utilisation of injected gas rapidly declines as the minimum transverse dimension of the nozzle protrusions is increased. Little, if any, improvement in gas utilisation can be observed (in comparison with prior art devices) when the minimum transverse dimension of the protrusions (at their outer ends surrounding the nozzle orifices) exceeds about 12.5 mm. On the other hand a reduction of the minimum transverse dimension to a value below about 2 mm would result in bubble growth by "climb down" of the sides of the protrusion. However, as already stated, considerations of mechanical strength make it preferable to hold the minimum transverse dimension of the protrusion at a somewhat higher value.

The minimum height of the protrusions to enable control of bubble size as envisaged in the invention is 3 mm, although a height of at least 6 mm is normally employed. It is often advantageous to make the protrusions higher than the envisaged operating minimum in order to allow for erosion of the nozzles which may occur during service. There is no maximum in respect of the height of the protrusions in relation to effective control of bubble size. The actual height (length) of the protrusions is selected in accordance with the characteristics of the chosen refractory material to provide adequate mechanical strength. The selected protrusion height must also be consistent with the need to maintain an adequate head of molten metal above the tops of the protrusions to enable effective degassing, inclusion-removal or other objectives of gas sparging to be achieved as the gas floats up through the molten metal. While theoretically the height of the protrusions is unlimited, so long as it is consistent with the foregoing requirement, a protrusion height of 6–10 mm is adequate. The mechanical strength of the protrusions decreases with increased height and the use of protrusions of a height exceeding 25 mm is not recommended.

Protrusions can be of circular, square, rectangular or any conveniently formable cross-section. The sides of each protrusion can be tapered either outwardly (to make the cross-section at the top of the protrusion smaller than at the bottom), or inwardly (to make the cross-section at the top of the protrusion larger than at the bottom), or the sides can be vertical with no taper.

Outwards taper is to be preferred where ease of removal of metal skull (e.g. in batch as opposed to fully continuous casting operations) or mechanical strength of protrusions are important considerations. The angle with the vertical should not be too great, or the bubble will grow by "climbing down" the side of the protrusion. To minimise this effect in practice we have found that the angle to the vertical should not be more than 15° when the transverse dimension at the top of the protrusion is 6 mm. A larger transverse dimension would permit a bigger angle; conversely a smaller transverse dimension requires a smaller angle.

A growing bubble forming at a nozzle protrusion overcomes the surface tension and breaks away from the nozzle when the angle between the interior of the bubble wall at the point of contact and the protrusion horizontal surface exceeds a critical value. The critical value decreases progressively as the minimum transverse dimension of the protrusion increases, so that the bubble will break away from an outward taper on a large protrusion, while on a similar taper on a small protrusion the bubble wall may not reach the critical value and the boundary of the bubble may therefore climb down the taper. It is difficult to predict the permissible amount of outward taper for a protrusion to avoid climb down since this is part dependent on the surface tension and of the density of the molten metal and in part on the cross sectional shape of the protrusion.

From the viewpoint of efficiency of control of bubble size, inwardly tapered protrusions are preferred because such a shape helps prevent "climb down" of bubbles referred to above. However, the ability to form such protrusions and their resistance to erosion in service depends on the properties of the refractory material used for their fabrication. Metal skull removal becomes a problem when such a shape is used.

Some benefits of inwards and outwards taper can be combined by machining or otherwise forming a notch or re-entrant in the sides of an outwardly tapering protrusion immediately below the outer end of the protrusions.

If desired, protrusions of any shape can be strengthened by providing thin refractory ribs which join each protrusion to one or more of its neighbours. While it is most convenient for the production of a unitary diffuser plate to form the protrusions with flat outer end surfaces, the end faces may be somewhat convex or concave without disadvantage.

The spacing between adjacent protrusions is at least of the same order of size as the width of the end faces of protrusions themselves to avoid all risk of contact and consequent coalescence between the incipient bubbles at adjacent nozzles. Preferably the spacing between adjacent protrusions is 0.8–2 times the width of the protrusion end faces. So long as the latter condition is met, any number of protrusions may be provided. There is clearly an incentive to provide as many protrusion nozzles as possible, packed as closely as possible, i.e. to provide the maximum number of protrusion nozzles per unit of surface.

Since growing bubbles become progressively more unstable if they grow out of round, limiting the spread of a bubble in one diametrical direction has the effect of limiting its growth in a direction at right angles to the first direction. The protrusions can therefore take the shape of parallel ribs, preferably extending transverse to the direction of metal flow so that the moving metal tears the growing bubbles from the top of the ribs. In each such rib a row of gas orifices is provided, the spacing between each orifice being such that the bubbles growing at each orifice do not have time to coalesce with the bubbles growing at adjacent orifices in the same rib before being torn away. Since the spread of a bubble transversely of the rib is limited when it meets the rib edges, the spread of the bubble longitudinally of the rib is also checked although the degree of control of bubble size is less precise. This is somewhat offset by the fact that the continuous ribs are stronger than the individual protrusions and therefore the width of the ribs may conveniently be small. The distance between adjacent orifices in the ribs should be more than twice the width of the ribs, more preferably about three times the width of the ribs to ensure that bubble coalescence does not take place.

The periphery of the top surface of each protrusion or edges of each rib constitute an abrupt discontinuity to check or hinder further lateral movement of the metal/gas interface across the surface of a diffuser plate or other structure. Instead of providing gas orifices in outwardly extending ribs or protrusions, bubble growth-hindering discontinuities may be formed by the peripheries of discrete recesses arranged between gas orifices in an otherwise continuous surface. Such discontinuities may be formed by drillings in the surface of a refractory plate in the intervals between the gas orifices therein. Where the centre of each drilling is on the line joining the centres of a pair of adjacent orifices the diameter of the drilling should exceed half the centre to centre distance of the pair of adjacent orifices. Where the centre of each drilling is located equidistant from more than two orifices in a regular arrangement, such as square or hexagonal, of orifices the shortest distance between the peripheries of any two adjacent drillings is preferably no more than one quarter of the centre to centre distance of adjacent orifices so as to leave no more than a thin rib between each pair of adjacent orifices.

DETAILED DESCRIPTION

Referring now to the accompanying drawings.

Figure 1:
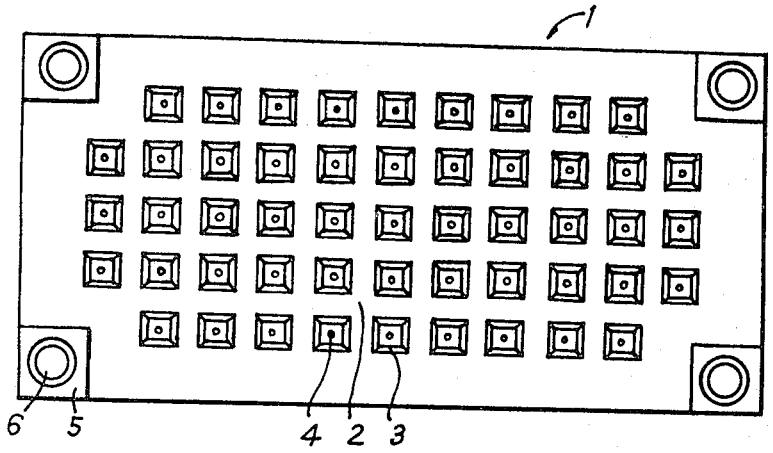
FIGS. 1 and 2 are respectively a plan and a longitudinal section of a diffuser plate made in accordance with the invention.
Figure 2:
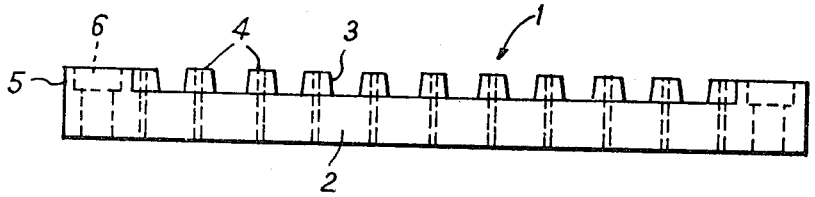

FIGS. 1 and 2 show a diffuser plate 1 in accordance with the invention. The diffuser plate has a thick base portion 2 and integral protrusions 3. Each protrusion is of square-section and is slightly tapered, as shown. Each protrusion 3 is centrally drilled to provide a gas orifice 4.

Figure 3:
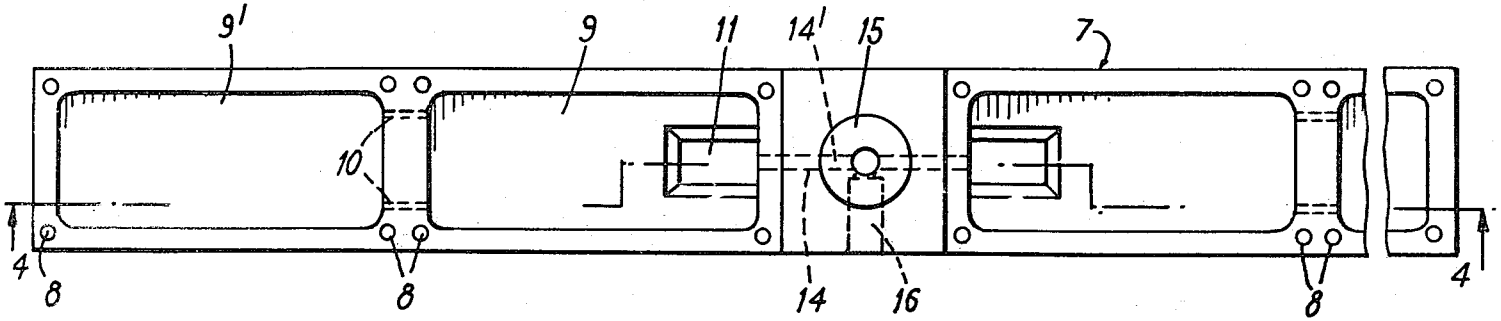
FIG. 3 is a plan of a base plate to receive four of the diffuser plates of FIGS. 1 and 2.
Figure 4:
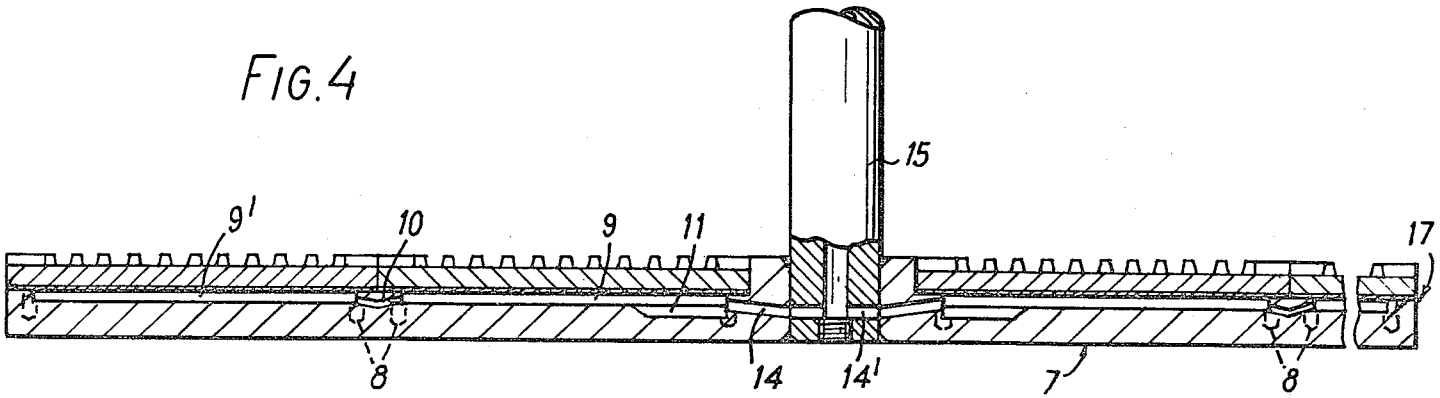
FIG. 4 is a longitudinal section of a diffuser assembly, formed of a base plate of FIG. 3 and diffuser plates of FIGS. 1 an 2.

In addition to the protrusions 3 the plate 1 is provided with corner bosses 5, drilled at 6 to receive holding down bolts for securing it to the base shown in FIGS. 3 and 4.

The function of the base plate shown in FIGS. 3 and 4 is to form a plenum chamber in association with each diffuser plate. It is preferred that this be made as thin as possible so as to allow maximum submersion of the tips of the nozzles on the diffuser plates below the surface of the metal flowing over them.

The base plate 7 is provided with tapped holes at 8 to secure the four diffuser plates thereto by bolts received in the drillings 6. At the diffuser plate positions shallow recesses 9, 9' are machined in the upper surface. The recess 9' communicates with recess 9 via drillings 10. Recess 9 is locally deepened at 11 to provide an entry for a drilling 14 which communicates with a drilling 14' in a gas supply fitting 15, locked in the base plate 7 by a key 16. Removal of the latter enables separation of the assembly into its constituent parts. A sheet of ceramic paper 17 is squeezed between the base plate 7 and the diffuser plate 1 to prevent leakage of gas through the gap between these two parts and to allow an appropriate gas pressure to build up in the plenum chambers.

The diffuser and base plates are preferably made from machined graphite or from moulded silicon carbide or other suitable refractory material. If desired, a castable refractory can be used. Alternatively, if desired, cast iron or other suitable refractory metal can be used. As yet a further alternative, the protrusions can be inserts of refractory material, which may be ceramic or metal, implanted in a refractory base plate which may or may not be of the same material as the inserts.

Figure 5:
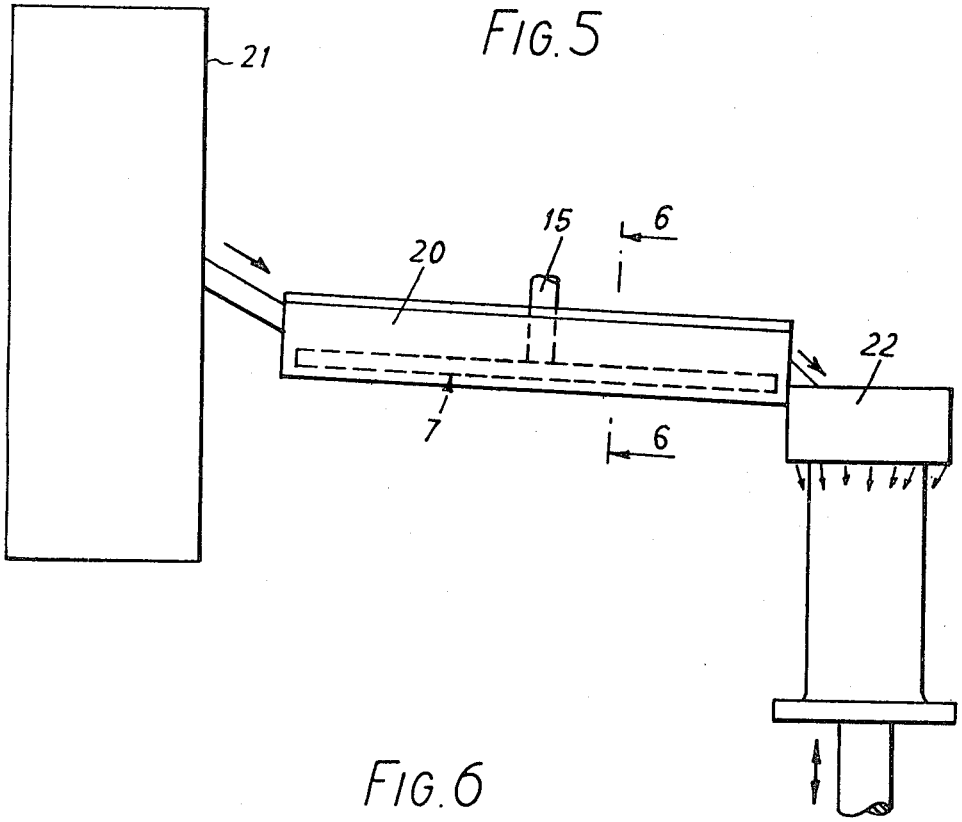
FIG. 5 is a diagrammatic indication of the installation of a diffuser assembly in a semi continuous casting system.

Referring to FIG. 5, a diffuser assembly of FIG. 4 is shown positioned in a trough 20 for delivering metal from a furnace 21 to a direct-chill continuous casting station 22.

Figure 6:
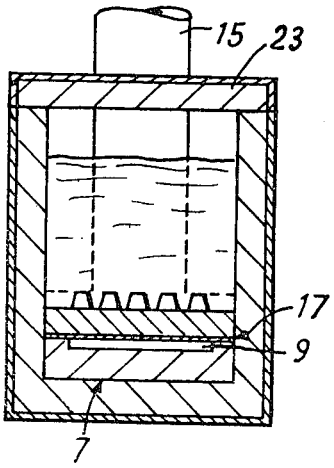
FIG. 6 is a cross section of a trough with a diffuser assembly installed therein.

FIG. 6 shows a cross section of the trough 20 with the diffuser assembly installed therein, the trough 20 being provided with a cover 23 over the diffuser assembly so as to maintain an atmosphere of the sparging gas over the molten metal in transit through the trough.

Figure 7:
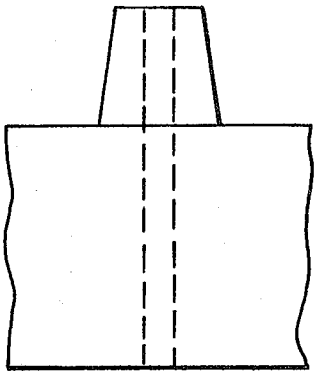
FIGS. 7 to 9 illustrate different forms of the protrusion nozzles on the diffuser plate of FIGS. 1 and 2.
Figure 8:
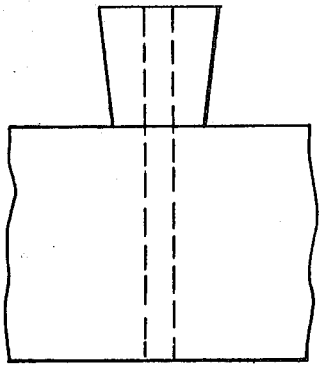
Figure 9:
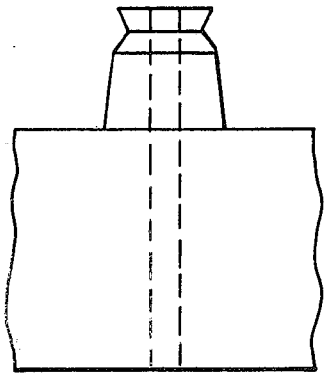

FIGS. 7 to 9 respectively show on a larger scale various forms of the protrusion nozzles 3 of the diffuser plate of FIGS. 1 and 2. FIG. 7 shows an outwardly tapering protrusion nozzle, FIG. 8 shows an inwardly tapering protrusion nozzle and FIG. 9 shows an outwardly tapering protrusion nozzle with notched sides.

The diffuser plates of the present invention may be employed as a means for injecting gas into a stream of molten metal in a conventional transfer trough by introduction to the trough as shown in FIGS. 5 and 6. More than one assembly may be mounted in the trough if desired. Alternatively, if desired, one or more such diffuser assemblies can be employed in a conventional gas treatment fluxing box, but the aforementioned disadvantages of using such a box would then apply.

Alternatively, one or more diffuser plates or diffuser assemblies can be installed in the bottom of a transfer trough or fluxing box, arranged in such a way that the surface of the plate at the base of the protrusions is at the same level as the bottom of the trough or box. When gas injection using the apparatus of the invention is carried out to effect in-transit sparging, whether in a transfer trough or fluxing box, a sufficient number of diffuser plates is provided to effect a substantial reduction of the gas content, inclusions or other impurities, in the flowing metal.

When the apparatus and method of the invention is used to effect degassing of molten metal, it is desirable to operate the system in such a way as to prevent re-entry of gas, e.g., hydrogen from moisture in the ambient atmosphere. This can be prevented by maintenance of a controlled atmosphere above the metal surface in the zone where the bubbles emerge by, e.g. installation of a cover over the transfer trough as shown in FIG. 6 and/or use of an appropriate molten cover flux e.g., of the alkali metal chloride or chloride/fluoride types when the molten metal is aluminium or an aluminium alloy.

EXAMPLES

In one arrangement a pair of diffuser assemblies, each holding four diffuser plates of size approximately 20 cm×10 cm provided each with 51 nozzles, was positioned in a transfer trough between a holding furnace and a casting station, as shown in FIG. 5. During a test there was a flow of molten aluminium alloy through the trough at a rate of 150 kg/min. and the depth of metal over the diffuser plates was approximately 10 cm. The residence time of the metal over the diffuser plates was about 20 sec. and the gas (100% argon) flow was approximately 100 liters/min. for a gas consumption of about 670 liters per tonne of metal treated.

Even with an apparatus of such restricted size significant reduction in the hydrogen content of the alloy was effected as the result of the small bubble size achieved (estimated as 6–10 mm diameter).

The test results obtained with various aluminium alloys using the metal and gas flow rates indicated above are set out in the following table. The duration of the test was, in each case, 2 hrs., the metal being supplied to a wheel-type continuous caster.

| Alloy | Hydrogen content (ml $H_2$/100 g metal) Before Diffuser | After Diffuser | % Removal |
|---|---|---|---|
| Al - 2.35% Mg | 0.27 | 0.12 | 56 |
| - 0.20% Cr | 0.21 | 0.11 | 48 |
| Al - 5.0% Mg | 0.27 | 0.16 | 41 |
| | 0.49 | 0.33 | 33 |
| | 0.35 | 0.18 | 49 |
| Al - 5.15% Si | 0.26 | 0.18 | 31 |
| | 0.24 | 0.15 | 38 |
| Al - 0.9% Mg- | 0.22 | 0.16 | 27 |
| - 0.65% Si | 0.26 | 0.10 | 62 |

In another arrangement, five graphite diffuser plates of size approximately 20 cm×28 cm provided each with 122 nozzles, were positioned at the bottom of a specially adapted section of transfer trough between a holding furnace and a vertical direct-chill casting station. The depth of metal over the diffuser plates was approximately 20 cm. The residence time of the molten metal over the diffuser was about 30 sec.

During the tests, metal cleanliness was assessed upstream and downstream of the diffuser using a quantitative metallographic method. A significant reduction in the non-metallic particle content (e.g., agglomerated $TiB_2$, $Al_4C_3$, MgO and spinels) of each alloy tested was achieved. The test results obtained for two aluminium alloys are shown on the following table.

| ALLOY | DURATION OF TEST hr. | METAL FLOW RATE kg/min. | ARGON FLOW RATE l/min. | ARGON CONSUMPTION /tonne metal treated | TOTAL INCLUSION REMOVAL EFFICIENCY % |
|---|---|---|---|---|---|
| Al - 1% Mn - 0.6% Fe | 2¼ | 360 | 140 | 390 | 66 |
| Al - 2.5% Mg | 1½ | 475 | 240 | 500 | 73 |

The method and apparatus of the present invention are applicable for use with any of the conventional and non-conventional gases employed for sparging molten metals, for example chlorine, nitrogen, argon, freon and mixtures thereof.

While the gas diffuser plates of the present invention are preferably installed in a metal transit trough much of the benefit of the invention may be obtained by locating an array of diffuser plates or diffuser assemblies in the bottom of the holding furnace to perform in-furnace sparging of the metal.

Figure 10:
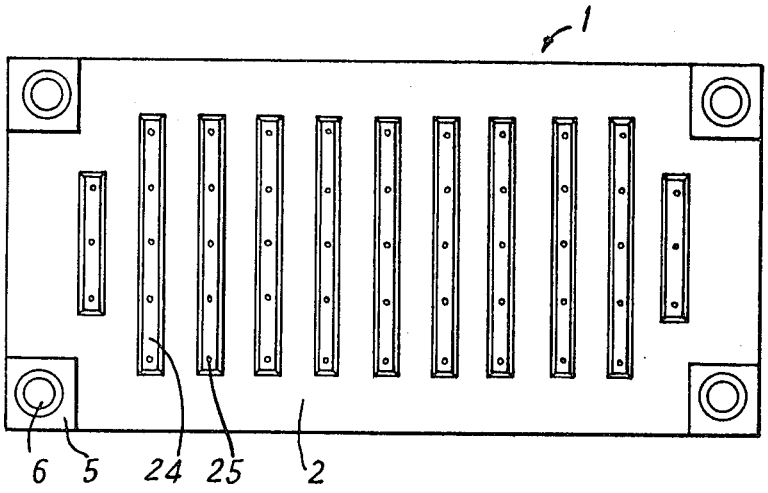
FIG. 10 illustrates a modified form of the diffuser plate of FIG. 1.

The modified diffuser plate of FIG. 10 is intended primarily for use in a stream of metal flowing transversely to the ribs.

As compared with FIG. 1 the individual square-section protrusions have been replaced by narrow continuous ribs 24 in which a row of gas orifices 25 are provided at a spacing of about 3 times the width of the outer surface of the rib. The orifice spacing is in fact similar to that of FIG. 1 because the ribs 24 are narrower than the protrusions 3.

I claim:

1. A gas diffuser plate for supplying sparging gas to molten metal comprising a plate-like base resistant to molten metal, said base having a series of spaced protrusions on the upper surface thereof, gas supply orifice means extending upwardly from the lower surface of said plate-like base to outlets in the top surfaces of said protrusions, each of said protrusions having a minimum transverse dimension of 2–12.5 mm. at the outer ends thereof and being spaced from adjacent protrusions by a distance of at least 0.8 times said minimum transverse dimension, each protrusion having at least two opposed side surfaces steeply inclined to the plate-like base and meeting the top surface of the protrusion at an included angle of no more than 105°, constituting abrupt discontinuities between said top surface and said side surfaces in such manner that gas bubbles growing at the outlets of said gas orifice means in contact with molten metal are restricted from lateral spread to prevent coalescence with bubbles growing at adjacent gas orifice means.

2. A gas diffuser plate according to claim 1 in which the height of said protrusions is in the range 3–25 mm.

3. A gas diffuser plate according to claim 1 in which the height of the individual protrusions is in the range of 6–10 mm.

4. A gas diffuser plate according to claim 1 in which the protrusions are of essentially square section and each have a single gas orifice extending therethrough.

5. A gas diffuser plate according to claim 1 in which the protrusions taper from the bottom to the top, the sides of the protrusions lying at an angle of no more than 15° to the vertical.

6. A gas diffuser plate according to claim 5 in which a notch is formed in at least one side face proximate the top end thereof.

7. A gas diffuser plate according to claim 1 in which the sides of the protrusion are essentailly vertical in relation to the plate-like base.

8. A gas diffuser plate according to claim 1 in which the protrusions taper from their upper ends towards their bottom ends adjacent the plate-like base.

9. A gas diffuser plate according to claim 4 in which the ratio of the spacing between upper ends of the protrusions and the minimum transverse dimensions at their upper ends is 0.8–2/l.

10. A gas diffuser plate according to claim 1 in which said protrusions are in the form of spaced ribs, gas orifices being spaced therealong at intervals such that emerging bubbles do not coalesce.

11. A gas diffuser plate according to claim 10 in which the spacing between adjacent gas orifices in each rib is a least twice the width of the top surface of said rib.

12. A gas diffuser plate according to claim 1, wherein each of said protrusions has a flat top surface.

13. In a system for casting molten metal comprising molten metal supply means, mold means and means for transfer of molten metal from said supply means to said mold means, a gas diffuser positioned between said supply means and said mold means and arranged to sparge said molten metal by supplying a stream of discrete gas bubbles of controlled size to a stream of molten metal in transit from said supply means to said mold means, said gas diffuser comprising a base member and at least one gas diffuser plate secured thereto to define a gas plenum chamber under said diffuser plate and means for supplying gas to said plenum chamber, said gas diffuser plate comprising a plate-like base resistant to molten metal, said base having a series of spaced protrusions on the upper surface thereof, said protrusions having gas supply passages extending upwardly therethrough from the lower surface of said plate-like base to orifices at the upper surface of said protrusions, each of said protrusions having a flat upper surface and at least two opposed side surfaces sharply inclined to said base and to said upper surface to form abrupt discontinuities at the junctions of said side surfaces and said upper surface, said protrusions being spaced from adjacent protrusions and said orifices being sized and disposed in such manner that gas bubbles growing at said gas orifices in contact with molten metal flowing through said transfer means are restricted from lateral spread to prevent coalescence with bubbles growing at adjacent gas orifices.

14. A system according to claim 13 in which said gas diffuser is located in a passage means intermediate said molten metal supply means and said mold means.

* * * * *